US005733388A

United States Patent [19]

Kurebayashi et al.

[11] Patent Number: 5,733,388

[45] Date of Patent: Mar. 31, 1998

[54] STEEL COMPOSITION FOR BEARINGS AND METHOD OF PRODUCING THE SAME

[75] Inventors: Yutaka Kurebayashi, Handa; Sadayuki Nakamura, Mie-ken; Masao Goto, Yao; Atsuhiko Ohta, Kashiwara, all of Japan

[73] Assignees: Daido Tokiushuko Kabushiki Kaisha, Osaka, Japan; Koyo Seiko Co., Ltd., Osaka, Japan

[21] Appl. No.: 621,938

[22] Filed: Mar. 25, 1996

Related U.S. Application Data

[63] Continuation-in-part of Ser. No. 461,863, Jun. 5, 1995, abandoned.

[30] Foreign Application Priority Data

Aug. 11, 1994 [JP] Japan ..... 6-189569

[51] Int. Cl.[6] ..... C22C 38/22; C21D 9/40

[52] U.S. Cl. ..... 148/334; 148/622; 148/906

[58] Field of Search ..... 148/622, 334, 148/906; 420/105

[56] References Cited

U.S. PATENT DOCUMENTS

| | | | |
|---|---|---|---|
| 3,929,523 | 12/1975 | Kinoshi et al. | 148/526 |
| 4,023,988 | 5/1977 | Stickels et al. | 148/622 |
| 4,581,079 | 4/1986 | Borik | 148/334 |
| 5,077,003 | 12/1991 | Muraoka et al. | 420/104 |
| 5,186,768 | 2/1993 | Nomoto et al. | 148/580 |

FOREIGN PATENT DOCUMENTS

| | | |
|---|---|---|
| 0 571 667 | 12/1993 | European Pat. Off. . |
| 1-306542 | 12/1989 | Japan . |
| 2-294451 | 12/1990 | Japan . |
| 2294451 | 12/1990 | Japan . |
| 2 225 022 | 5/1990 | United Kingdom . |

*Primary Examiner*—Deborah Yee
*Attorney, Agent, or Firm*—Davis and Bujold

[57] ABSTRACT

Bearing steel materials that are superior in cold workability, machinability, hardenability and rolling contact fatigue life are provided. During the processing of steel materials, the generation of large carbides, that detrimentally affect the rolling contact fatigue life of the steel, is inhibited, thereby obviating the necessity of a heat treatment for dissolving the carbides. The present steel material contains the following alloy elements in percentage by mass: 0.55% to 0.82% of carbon; 0.05% to 0.20% of silicon; 0.50% or less of manganese; 0.90% to 1.30% of chromium; 0.05% to 0.30% of molybdenum; and the remaining percentage substantially of iron. After the spheroidizing annealing of the steel material, the total cross-sectional area rate of carbide is 25% or less.

7 Claims, No Drawings

STEEL COMPOSITION FOR BEARINGS AND METHOD OF PRODUCING THE SAME

This is a continuation-in-part application of U.S. application Ser. No. 08/461,863 filed Jun. 5, 1995, now abandoned.

FIELD OF THE INVENTION

This invention relates to a bearing steel that contains an optimum quantity of chromium and molybdenum, thereby providing enhanced hardenability, contains a reduced quantity of silicon and manganese, thereby providing enhanced cold workability, and further contains an optimum quantity of carbon and chromium, thereby providing a reduced area rate of spheroidized carbide. Therefore, the bearing steel is provided with enhanced machinability and rolling contact fatigue life.

BACKGROUND OF THE INVENTION

Conventionally, a steel material for use in a bearing ball, outer ring, inner ring or other is bearing component required to have superior rolling contact fatigue life, hardenability, machinability, and workability. SUJ2 steel (according to the Japanese Industrial Standards), for example, which contains 1% by mass of carbon and 1.5% by mass of chromium, is widely used as the steel material for making bearings.

The SUJ2 steel, however, has the following problems, and a further improved steel material has therefore been demanded. Specifically, while the molten SUJ2 steel is cast and changes from its liquid phase into a solid phase, relatively large carbides are easily generated, which deteriorate the rolling contact fatigue life of the steel. Therefore, the casting needs to be followed by heat treatment, such that the carbides are again dissolved in the basis material.

The SUJ2 steel material, which contains a relatively large quantity of carbon, is liable to crack, if, after hot rolling, it is cooled too fast. Therefore, slow cooling is usually performed subsequent to the hot rolling. Depending on the conditions of the slow cooling, however, netted carbides are easily generated, thereby deteriorating the rolling contact fatigue life. To solve the problem, the aforementioned heat treatment is again required, thereby consuming a large quantity of energy. Therefore, the method of processing the conventional steel material needs to be improved.

For the manufacture of bearings, a basis material is usually hot forged, spheroidizing annealed or normalized, and then cut or processed. During the spheroidizing annealing, spherical carbides having an area rate of about 30% are generated, thereby hardening the material by the hardened material. For example, a cutting tool is easily damaged. The material becomes inferior in machinability. If the SUJ2 steel is normalized, it becomes pearlitic and much harder than if it is spheroidizing annealed. Even if the normalized steel is heat treated, the machinability of the steel cannot be improved. Therefore, the development of bearing steels superior in machinability has been demanded.

The manufacture of the mechanical components of bearings is mainly carried out by hot working the steel. However, cold working of the steel is preferable, so that precision in the dimension of components can be attained and energy can be saved. The SUJ2 steel has little cold workability, and, therefore, the durability of a metal die is shortened. Moreover, the steel being died is liable to crack. Cold working of SUJ2 steel is relatively difficult. Therefore, the development of cold workable bearing steel has been requested.

Rolling durability is intrinsically required by bearing components. In the industrial field, mechanical components are increasingly being miniaturized and lightened, while the SUJ2 steel is requested to have a long life. Therefore, the provision of a material that is superior in rolling contact fatigue life has been demanded.

SUMMARY OF THE INVENTION

Wherefore, an object of this invention is to provide a bearing steel having good cold workability, machinability, hardenability and an enhanced rolling contact fatigue life, in which, different from the most widely used SUJ2 steel, the generation of relatively large carbides, that detrimentally affect the rolling contact fatigue life of the steel, is inhibited, thereby obviating the necessity of heat treatment.

To attain this and other objects, the invention provides a bearing steel containing the following alloy elements in percentage by mass: 0.55% to 0.82% of carbon; 0.05% to 0.20% of silicon; 0.50% or less of manganese; 0.90% to 1.30% of chromium; 0.05% to 0.30% of molybdenum; and the remaining percentage substantially of iron. After spheroidizing annealing, the total area rate of carbide in an optional cross section of the above bearing steel is 25% or less.

In another aspect of the invention, the bearing steel further contains, in percentage by mass, at least one alloying element selected from the group consisting of 0.50% or less of vanadium, 2.00% or less of nickel; 0.010% to 0.20% of niobium; and 5 ppm to 50 ppm of boron.

The content of the alloying elements is restricted for following reasons.

The allowable content of carbon ranges between 0.55% and 0.82% by mass. Carbon is dissolved in the basis material of the steel, thereby strengthening the basis material. At least 0.55% by mass of carbon needs to be contained in the steel, such that the hardness of the hardened or tempered steel is at least HRC60 and the rolling contact fatigue life is thereby enhanced. Excess content of carbon in the steel would deteriorate the steel's cold workability, increase the area rate of carbide after spheroidizing annealing, and reduce its machinability. Therefore, the upper limit of carbon content is specified as 0.82% by mass.

The upper limit of silicon content is 0.20% by mass. Silicon is a known element for enhancing the rolling contact fatigue life. Therefore, materials containing a large quantity of silicon have been developed. If the silicon content is excessive, however, the steel has a raised resistance to deformation and is thereby relatively brittle and liable to crack during cold working of the steel. To maintain good cold workability, silicon is added to the steel as a deoxidizer. To avoid insufficient deoxidizing, the upper limit of the silicon content is specified in the invention.

The upper limit of manganese content is 0.50% by mass. Manganese is a known element for enhancing the hardenability. Therefore, in the invention, manganese is added for hardening the steel. However, like silicon, manganese is a ferrite reinforcing element. If the manganese content is excessive, cold workability as well as rolling contact fatigue life would be lowered. During the processing of the steel, manganese is added to the steel as a deoxidizer. To avoid insufficient deoxidizing, the upper limit of the content is specified in the invention.

The allowable content of chromium ranges between 0.90% and 1.30% by mass. During casting, the content of chromium results in the generation of relatively large carbides. When carbide is deposited in the steel, the rolling contact fatigue life or other physical property of the steel is remarkably deteriorated. The content of chromium is preferably 1.30% at maximum, such that the carbon is dissolved in the basis material, generation of carbides is avoided, and the steel processing costs are thus minimized. In the invention, the steel contains a reduced quantity of hardening elements such as silicon or manganese. Therefore, to supplement the hardenability and enhance the basic characteristic of rolling contact fatigue life, the lower limit of chromium content is specified as 0.90% by mass.

The upper limit of molybdenum content is 0.30% by mass. Molybdenum, like manganese, hardens the steel, and also improves its rolling contact fatigue life. However, if the content exceeds the upper limit, the material cost is raised, while no remarkable improvement in rolling contact fatigue life or hardenability can be expected.

If the total cross-sectional area rate of carbide, or the total area of carbide in an optional cross section of the steel material, exceeds the specified upper limit of 25%, the steel would be difficult to cut or process without annealing. Also, cold working of the steel would become difficult and the machinability of the steel would be lowered.

In the invention, by adding at least one element of vanadium, nickel, niobium and boron in a specific percentage by mass to the steel, the hardenability or rolling contact fatigue life of the steel can be greatly enhanced.

The upper limit of vanadium content is specified as 0.50% by mass. Vanadium can extend the rolling contact fatigue life of the steel. An excess content of vanadium, however, would impair the cold workability of the steel.

The upper limit of nickel content is specified as 2.00% by mass. If the nickel content exceeds the upper limit, no further improvement is realized in the steel's rolling contact fatigue life.

The allowable content of niobium ranges between 0.010% and 0.20% by mass. Niobium combines with carbon or nitrogen to form NbC, NbCN or NbN, such that crystal grains are prevented from becoming too coarse during the heating treatment at high temperatures, for example, quenching, thereby enhancing the steel's rolling contact fatigue life. However, if an excess quantity of niobium is added to the steel, the precipitation of relatively large NbCN or NbC occurs during the casting stage, thereby reducing the steel's rolling contact fatigue life. A niobium content in the specified range improves the rolling contact fatigue life of steel.

The allowable content of boron ranges between 5 ppm and 50 ppm. Boron can harden the steel without deteriorating its cold workability and machinability. Even if the boron content exceeds the upper limit of 50 ppm, however, no further improvement in hardenability can be expected. If the boron content is lower than the lower limit of 5 ppm, no improvement in hardenability can be expected. Therefore, the range of the boron content is specified.

Since the steel of the invention has a reduced carbon content, the large carbides are prevented from being deposited during casting, thereby obviating the necessity of a heat treatment for dissolving the carbides. Furthermore, the generation of netted carbides is prevented during hot rolling, thereby obviating the necessity of normalizing or other heat treatment for dissolving the netted carbides. Since the generation of these carbides is avoided, the rolling contact fatigue life of the steel is enhanced.

Also in the invention, the steel has a reduced quantity of ferrite reinforcing elements such as carbon, silicon and manganese, the hardness of the steel after spheroidizing annealing is therefore decreased. The steel has a reduced resistance to deformation during cold working and is prevented from cracking, even during a relatively high degree of processing or refining. The cold workability of the steel is thus enhanced.

The steel of the invention has an optimized quantity of carbon and chromium. The cross-sectional area rate of spherical carbides during the spheroidizing annealing is adjusted to 25% or less. Therefore, the machinability of the steel is improved. Moreover, since the steel of the invention contains the optimized quantity of carbon, chromium and molybdenum, both the hardenability and rolling contact fatigue life of the steel is greatly increased.

By solving various problems arising when steel rods or steel bars for use as bearings is processed, the invention provides a bearing steel material that is superior in cold workability, machinability, hardenability and rolling contact fatigue life. Further, by adding the specified quantity of at least one element selected from vanadium, nickel, niobium and boron to the steel material, the steel's hardenability or rolling contact fatigue life can be enhanced even further.

DETAILED DESCRIPTION OF THE PREFERRED EMBODIMENTS

The embodiments of the invention are now detailed together with reference examples.

Embodiments 1–10 and Reference Examples 1–5 of steel having the compositions shown in Table 1 were molten, cast and hot forged to form round bars having a diameter of 35 mm and 80 mm. Subsequently, the bars were normalized: retained at 850° C. for one hour with subsequent cooling in still air. Lastly, the bars were spheroidizing annealed: retained at 760° C. for three hours and cooled down to 650° C. in five hours with subsequent cooling in still air. Reference Example 1 is the conventional SUJ2 steel.

| | CHEMICAL COMPOSITION [% BY MASS] | | | | | | | | |
|---|---|---|---|---|---|---|---|---|---|
| | C | Si | Mn | Cr | Mo | V | Ni | Nb | B |
| EMBODIMENT 1 | 0.59 | 0.11 | 0.48 | 0.81 | 0.18 | — | — | — | — |
| EMBODIMENT 2 | 0.65 | 0.19 | 0.29 | 1.01 | 0.05 | — | — | — | — |
| EMBODIMENT 3 | 0.65 | 0.05 | 0.30 | 1.23 | 0.30 | — | — | — | — |
| EMBODIMENT 4 | 0.70 | 0.16 | 0.05 | 1.29 | 0.18 | — | — | — | — |
| EMBODIMENT 5 | 0.70 | 0.11 | 0.19 | 1.15 | 0.18 | 0.05 | — | — | 5 ppm |
| EMBODIMENT 6 | 0.73 | 0.13 | 0.40 | 1.16 | 0.19 | — | 1.99 | — | — |
| EMBODIMENT 7 | 0.65 | 0.14 | 0.46 | 1.19 | 0.20 | — | 0.45 | 0.03 | — |
| EMBODIMENT 8 | 0.65 | 0.18 | 0.36 | 1.19 | 0.21 | 0.10 | — | — | 45 ppm |
| EMBODIMENT 9 | 0.77 | 0.69 | 0.47 | 1.07 | 0.13 | — | — | — | — |
| EMBODIMENT 10 | 0.80 | 0.13 | 0.48 | 1.08 | 0.16 | — | 0.47 | — | — |

-continued

| | CHEMICAL COMPOSITION [% BY MASS] | | | | | | | | |
|---|---|---|---|---|---|---|---|---|---|
| | C | Si | Mn | Cr | Mo | V | Ni | Nb | B |
| REFERENCE EXAMPLE 1 | 1.01 | 0.25 | 0.30 | 1.51 | 0.01 | — | — | — | — |
| REFERENCE EXAMPLE 2 | 1.01 | 0.54 | 0.78 | 1.46 | 0.01 | — | — | — | — |
| REFERENCE EXAMPLE 3 | 0.90 | 0.01 | 0.56 | 2.30 | 0.01 | — | — | — | — |
| REFERENCE EXAMPLE 4 | 0.45 | 0.04 | 0.46 | 0.78 | 0.01 | — | — | — | — |
| REFERENCE EXAMPLE 5 | 0.76 | 0.23 | 0.78 | 1.45 | 0.01 | — | — | — | — |

EXPERIMENT 1

The Area Rate of Carbides

The area rate of carbides of the spheroidizing annealed round bars with a diameter of 80 mm was measured by analyzing an image and ascertaining the total carbide area in the cross section of 10 $mm^2$. The measurement was taken for each of the sample, EMBODIMENT 1–10 and REFERENCE EXAMPLE 1–5, and the results are shown in Table 2.

TABLE 2

| | CARBIDE AREA RATE [%] |
|---|---|
| EMBODIMENT 1 | 15.7 |
| EMBODIMENT 2 | 21.6 |
| EMBODIMENT 3 | 22.2 |
| EMBODIMENT 4 | 23.3 |
| EMBODIMENT 5 | 19.1 |
| EMBODIMENT 6 | 24.2 |
| EMBODIMENT 7 | 19.6 |
| EMBODIMENT 8 | 19.8 |
| EMBODIMENT 9 | 23.7 |
| EMBODIMENT 10 | 24.2 |
| REFERENCE EXAMPLE 1 | 31.4 |
| REFERENCE EXAMPLE 2 | 29.1 |
| REFERENCE EXAMPLE 3 | 28.6 |
| REFERENCE EXAMPLE 4 | 18.5 |
| REFERENCE EXAMPLE 5 | 26.2 |

As shown in Table 2, the carbide area rate of Embodiments 1–10 was less than 25%, whereas that of Reference Examples 1–3 and 5 exceeded 25%. Although the carbide area rate of Reference Example 4 was less than 25%, the composition of the example was different from the embodiments, as shown in Table 1. Therefore, the Reference Example 4 is inferior in performance as detailed below.

EXPERIMENT 2

Rolling Durability Test

Twenty test pieces of each of the embodiments 1–10 and the reference examples 1–5 were mechanically processed from the spheroidizing annealed round bars with a diameter of 35 mm. The pieces were heated and retained at 850° C. and cooled in oil. Subsequently, they were hardened and tempered at 180° C. for two hours. A rolling contact fatigue life test was then conducted on the test pieces.

The rolling contact fatigue life test was conducted on all the test pieces, under the load stress of 5880 MPa using a radial rolling contact fatigue life tester. The life of the test pieces was evaluated on the assumption that the life values, with Weibull cumulative damage probabilities of 10% and 50%, were L10 and L50, respectively. The test results are shown in Table 3.

TABLE 3

| | L10 LIFE | L50 LIFE |
|---|---|---|
| EMBODIMENT 1 | $7.2 \times 10^7$ | $25.7 \times 10^7$ |
| EMBODIMENT 2 | $7.6 \times 10^7$ | $22.4 \times 10^7$ |
| EMBODIMENT 3 | $9.9 \times 10^7$ | $19.8 \times 10^7$ |
| EMBODIMENT 4 | $11.5 \times 10^7$ | $26.8 \times 10^7$ |
| EMBODIMENT 5 | $16.4 \times 10^7$ | $\geqq 30 \times 10^7$ |
| EMBODIMENT 6 | $19.5 \times 10^7$ | $\geqq 30 \times 10^7$ |
| EMBODIMENT 7 | $20.1 \times 10^7$ | $\geqq 30 \times 10^7$ |
| EMBODIMENT 8 | $12.5 \times 10^7$ | $\geqq 30 \times 10^7$ |
| EMBODIMENT 9 | $22.6 \times 10^7$ | $\geqq 30 \times 10^7$ |
| EMBODIMENT 10 | $24.6 \times 10^7$ | $\geqq 30 \times 10^7$ |
| REFERENCE EXAMPLE 1 | $4.1 \times 10^7$ | $9.3 \times 10^7$ |
| REFERENCE EXAMPLE 2 | $2.8 \times 10^7$ | $6.2 \times 10^7$ |
| REFERENCE EXAMPLE 3 | $0.4 \times 10^7$ | $0.9 \times 10^7$ |
| REFERENCE EXAMPLE 4 | $0.3 \times 10^7$ | $1.0 \times 10^7$ |
| REFERENCE EXAMPLE 5 | $0.5 \times 10^7$ | $0.2 \times 10^7$ |

As shown in Table 3, Embodiments 1–10 have rolling contact fatigue life characteristics that are superior to those of Reference Example 1, SUJ2 steel, and Reference Examples 2–5. It is clearly seen that the steel of the invention has excellent rolling contact fatigue life.

EXPERIMENT 3

Cold Workability Test

Compression test pieces having a diameter of 6 mm and a height of 12 mm were mechanically processed from the spheroidizing annealed round bars having a diameter of 35 mm for each of the embodiments 1–10 and the reference examples 1–5. The cold workability of the test pieces was evaluated by measuring the resistance to deformation arising when the test pieces were deformed at the rate of 50%. That is, an increasing compressive load was applied to the test pieces. The magnitude of the compressive load was measured when the height of the test pieces was reduced to 50% of their original height, and the maximum rate of deformation, % reduction in height, at which they failed to crack was measured. The test results are shown in Table 4.

TABLE 4

| | RESISTANCE TO DEFORMATION AT WORK RATE OF 50% [MPa] | MAXIMUM WORK RATE [%] AT WHICH NO CRACKS ARE MADE |
|---|---|---|
| EMBODIMENT 1 | 749 | 84 |
| EMBODIMENT 2 | 781 | 85 |
| EMBODIMENT 3 | 784 | 83 |
| EMBODIMENT 4 | 787 | 84 |
| EMBODIMENT 5 | 784 | 81 |
| EMBODIMENT 6 | 762 | 79 |
| EMBODIMENT 7 | 770 | 82 |
| EMBODIMENT 8 | 771 | 81 |
| EMBODIMENT 9 | 787 | 81 |
| EMBODIMENT 10 | 791 | 79 |
| REFERENCE EXAMPLE 1 | 870 | 56 |
| REFERENCE EXAMPLE 2 | 1020 | 54 |
| REFERENCE EXAMPLE 3 | 880 | 62 |
| REFERENCE EXAMPLE 4 | 783 | 61 |
| REFERENCE EXAMPLE 5 | 882 | 64 |

As shown in Table 4, when a compressive stress is applied to the test pieces, Embodiments 1–10 have less resistance to deformation and a higher work rate until cracks are made, as compared with Reference Example 1 of the SUJ2 steel. Therefore, it is appreciated that the steel of the invention is superior to SUJ2 steel in cold workability.

EXPERIMENT 4

Machinability Test

The spheroidizing annealed round bars having a diameter of 80 mm were drilled or processed for the examination of machinability for each of the embodiments 1–10 and the reference examples 1–5. Specifically, the test pieces were processed by operating a drill (SKH51 according to the Japanese Industrial Standards), having a diameter of 5 mm, at a speed of 40 m per minute. The quantity or length of the bars that was before the drill was damaged and became inoperable was measured. The test results are shown in Table 5.

TABLE 5

| | PROCESSED QUANTITY [mm] |
|---|---|
| EMBODIMENT 1 | 3350 |
| EMBODIMENT 2 | 3254 |
| EMBODIMENT 3 | 2857 |
| EMBODIMENT 4 | 2671 |
| EMBODIMENT 5 | 2744 |
| EMBODIMENT 6 | 2585 |
| EMBODIMENT 7 | 2638 |
| EMBODIMENT 8 | 2829 |
| EMBODIMENT 9 | 2337 |
| EMBODIMENT 10 | 2256 |
| REFERENCE EXAMPLE 1 | 855 |
| REFERENCE EXAMPLE 2 | 523 |
| REFERENCE EXAMPLE 3 | 765 |
| REFERENCE EXAMPLE 4 | 2350 |
| REFERENCE EXAMPLE 5 | 1230 |

As shown in Table 5, the processed quantity of Embodiments 1–10 is larger than that of Reference Examples 1–5. It is thus appreciated that the steel of the invention is far superior in machinability as compared with Reference Examples 1–5.

EXPERIMENT 5

Hardenability Test

Test pieces were mechanically processed from the round bar having a diameter of 35 mm in a Jominy end quenching method. Hardenability was evaluated by measuring, from the end of the test piece, the length of the portion of the test piece in which a hardness of HRC50 or more was maintained. The test results are shown in Table 6.

TABLE 6

| | LENGTH AT WHICH HRC50 OR MORE HARDNESS IS OBTAINED [mm] |
|---|---|
| EMBODIMENT 1 | 11.5 |
| EMBODIMENT 2 | 12.3 |
| EMBODIMENT 3 | 12.7 |
| EMBODIMENT 4 | 13.1 |
| EMBODIMENT 5 | 13.4 |
| EMBODIMENT 6 | 13.6 |
| EMBODIMENT 7 | 13.3 |
| EMBODIMENT 8 | 13.8 |
| EMBODIMENT 9 | 13.7 |
| EMBODIMENT 10 | 13.9 |
| REFERENCE EXAMPLE 1 | 7.6 |
| REFERENCE EXAMPLE 2 | 7.1 |
| REFERENCE EXAMPLE 3 | 5.5 |
| REFERENCE EXAMPLE 4 | 5.2 |
| REFERENCE EXAMPLE 5 | 8.8 |

As shown in Table 6 Embodiments 1–10 have a greater length from the end surface in which a hardness HRC50 or harder is obtained, as compared with Reference Examples 1–5. Therefore, the steel of the invention has an improved hardenability.

As aforementioned, upon examining the results of the experiments, it is appreciated that the embodiments have a rolling contact fatigue life, cold workability, machinability and hardenability that are superior to those of the conventional SUJ2 steel and the other reference examples.

According to the invention, the large carbides are prevented from being deposited during casting of the steel, thereby obviating the necessity of a heat treatment for dissolving the carbides. Furthermore, netted carbides are prevented from generating during hot rolling, thereby obviating the necessity of a normalizing or other heat treatment for dissolving the netted carbides. Since the heat treatments are omitted, energy consumption is reduced. Also, by avoiding the generation of carbides, the rolling contact fatigue life of the steel is enhanced.

Also in the invention, the steel has a reduced resistance to deformation during cold working of the steel and does not crack even at high temperatures. The cold workability of the steel is thus enhanced.

The steel of the invention has an optimized quantity of carbon and chromium. The cross sectional area rate of the spherical carbides generated during spheroidizing annealing is adjusted to 25% or less. Therefore, the steel's machinability is improved. Moreover, since the steel of the invention contains an optimized quantity of carbon, chromium and molybdenum, both the hardenability and rolling contact fatigue life of the steel are greatly increased.

According to the invention, by improving the machinability, both hardenability and rolling contact fatigue life are also enhanced.

With the bearing steel of the present invention, having the aforementioned composition and carbide area rate, the problems arising when melting conventional bearing steels are solved. Superior hardenability, cold workability, machinability and rolling contact fatigue life are also provided. Furthermore, by adding the specified quantity of at least one element selected from vanadium, nickel, niobium and boron to the steel material, the hardenability or rolling contact fatigue life of the steel is enhanced even further.

What is claimed is:

1. A steel composition for use in manufacturing a bearing component, said steel composition consisting essentially of:

from 0.55% to 0.82% by mass of carbon;

from 0.05% to 0.20% by mass of silicon;

up to 0.50% by mass of manganese;

from 0.90% to 1.30% by mass of chromium;

from 0.05% to 0.30% by mass of molybdenum; and the balance by mass being substantially iron;

wherein said steel composition having been spheroidized annealed, said spheroidizing annealing being performed by retaining said steel composition at about 760° C. for about three hours, subsequently cooling down said steel composition to about 650° C. in about five hours with subsequent cooling in still air, to produce a total cross sectional area rate of carbide in an optional cross section of said steel composition of 24 percent or less and an L50 rolling contact fatigue life of at least $15\times10^7$.

2. A steel composition according to claim 1, further comprising up to 2.00% by mass for each element of at least one alloying element selected from the group consisting of vanadium, nickel and niobium.

3. A steel composition according to claim 1, further comprising at least one alloying element selected from the group consisting of:

up to 0.50% by mass of vanadium;

up to 2.00% by mass of nickel: and from 0.10% to 0.20% by mass of niobium.

4. A process for producing a steel composition for use in manufacturing a bearing component, said process comprising the step of combining:

from 0.55% to 0.82% by mass of carbon; from 0.05% to 0.20% by mass of silicon;

up to 0.50% by mass of manganese;

from 0.90% to 1.30% by mass of chromium;

from 0.05% to 0.30% by mass of molybdenum; and the balance by mass being substantially iron;

wherein said steel composition having been spheroidized annealed, said spheroidizing annealing being performed by retaining said steel composition at about 760° C. for about three hours, subsequently cooling down said steel composition to about 650° C. in about five hours with subsequent cooling in still air, to produce a total cross sectional area rate of carbide in an optional cross section of said steel composition of 25% or less.

5. A process according to claim 4, further comprising the step of adding up to 2.00% by mass for each element of at least one alloying element selected from the group consisting of vanadium, nickel, niobium and boron to said steel composition.

6. A process according to claim 4, further comprising the step of adding at least one alloying element selected from the group consisting of:

up to 0.50% by mass of vanadium;

up to 2.00% by mass of nickel; and from 0.010% to 0.20% by mass of niobium; to said steel composition.

7. A steel composition for use in manufacturing a bearing component, said steel composition comprising:

from 0.55 to 0.82% by mass of carbon;

from 0.05 to 0.20% by mass of silicon;

up to 0.50% by mass of manganese;

from 0.90 to 1.30% by mass of chromium;

from 0.05 to 0.30% by mass of molybdenum; and the balance by mass being substantially iron;

wherein said steel composition having been spheroidized annealed, said spheroidizing annealing being performed by retaining said steel composition at about 760° C. for about three hours, subsequently cooling down said steel composition to about 650° C. in about five hours with subsequent cooling in still air, to produce a total cross sectional area rate of carbide in an optional cross section of said steel composition of 25 percent or less and has improved rolling contact fatigue life.

* * * * *

UNITED STATES PATENT AND TRADEMARK OFFICE

CERTIFICATE OF CORRECTION

PATENT NO. : 5,733,388

DATED : March 31, 1998

INVENTOR(S) : Yutaka KUREBAYASHI, Sadayuki NAKAMURA, Masao GOTO and Atsuhiko OHTA It is certified that error appears in the above-identified patent and that said Letters Patent is hereby corrected as shown below:

Title page, item [73], first line, replace "Tokiushuko" with --Tokushuko--.

Signed and Sealed this

Twenty-seventh Day of October, 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,733,388

DATED : March 31, 1998

INVENTOR(S) : Yutaka KUREBAYASHI, Sadayuki NAKAMURA, Masao GOTO and Atsuhiko OHTA It is certified that error appears in the above-identified patent and that said Letters Patent is hereby corrected as shown below:

Title page, Section [73], second line, replace "Osaka" with "Nagoya".

Signed and Sealed this

Seventeenth Day of November, 1998

Bruce Lehman

*Attest:*

BRUCE LEHMAN

*Attesting Officer*

*Commissioner of Patents and Trademarks*